United States Patent [19]

Swinehart

[11] 4,103,299

[45] Jul. 25, 1978

[54] TWO-WIRE PILOT DEVICE SOLID STATE CONTROL SYSTEM

[75] Inventor: Merle R. Swinehart, Brookfield, Wis.

[73] Assignee: Cutler-Hammer, Inc., Milwaukee, Wis.

[21] Appl. No.: 731,509

[22] Filed: Oct. 12, 1976

[51] Int. Cl.[2] ..... G08B 21/00

[52] U.S. Cl. ..... 340/506; 340/538; 340/650

[58] Field of Search ..... 340/256, 408, 213 R, 340/409, 253 R, 226, 215, 216, 218

[56] References Cited

U.S. PATENT DOCUMENTS

| | | | |
|---|---|---|---|
| 3,665,461 | 5/1972 | Gnägi et al. | 340/256 X |
| 3,699,569 | 10/1972 | Lee | 340/256 X |

*Primary Examiner*—John W. Caldwell, Sr.
*Assistant Examiner*—Daniel Myer
*Attorney, Agent, or Firm*—Hugh R. Rather; William A. Autio; Michael E. Taken

[57] ABSTRACT

A line of 2-wire pilot devices using current level as a signal for implementing solid state control systems. A variety of alternative pilot devices such as flag type limit switch, magnetic type proximity switch, capacitance type proximity switch and temperature responsive switch, in addition to pushbutton switch, are usable as logic inputs to the system based upon two intermediate current levels. Shorted lines and open lines are detected by zero voltage and zero current levels, respectively. A variety of alternative outputs such as logic output and relay output are also useable in the system. In addition, tachometer and motion transducer systems with pulse inputs and pulse integrator and non-volatile memory outputs, respectively, are further possible modifications of the system.

12 Claims, 13 Drawing Figures

PILOT DEVICES IN PARALLEL

PILOT DEVICES IN SERIES

TACHOMETER

MOTION TRANSDUCER

TWO-WIRE PILOT DEVICE SOLID STATE CONTROL SYSTEM

BACKGROUND OF THE INVENTION

Solid state pilot devices made of sensors or transducers and active components ordinarily have required three wires, namely, a power supply wire, a signal output wire and a common wire, to connect such pilot devices to the control center. However, control system designers have been accustomed to using 2-wire pilot devices such as pushbutton switches, limit switches, pressure switches, etc., and for reasons of economy, prefer to keep the number of wires to a minimum when using solid state pilot devices rather than the ordinary mechanical types. It has, therefore, been found desirable to provide control means adapted to be operated by 2-wire, solid state pilot devices as well as by ordinary switches.

SUMMARY OF THE INVENTION

An object of the invention is to provide an improved solid state control system adapted to be operated by a variety of 2-wire solid state pilot devices as well as ordinary switches.

A more specific object of the invention is to provide a plurality of different types of 2-wire solid state pilot devices that provide a change in current level as an output signal.

Another specific object of the invention is to provide a solid state control system with current level sensors for responding to the change in operating current level from the aforesaid solid state pilot devices.

Another specific object of the invention is to provide 2-wire solid state pilot devices capable of being operated by a metal shield as a limit switch, a magnetic member as a proximity switch, a capacitance member as a proximity switch, or change in temperature as a temperature responsive switch to produce an abrupt change in operating current level.

Another specific object of the invention is to provide a solid state control system with zero current and zero voltage detectors for detecting and indicating open and shorted lines, respectively.

Another object of the invention is to provide 2-wire solid state pilot devices of the aforesaid type that may be connected in parallel for OR logic operation or in series for AND logic operation.

Another specific object of the invention is to provide the aforesaid control system with alternative output circuits of the logic or relay type.

Another specific object of the invention is to provide the aforesaid control system with start and stop solid state current sensors operable by respective remote 2-wire solid state start and stop pilot devices both of which are connected to the current sensors by three wires.

Other objects and advantages of the invention will hereinafter appear.

DESCRIPTION OF THE PREFERRED EMBODIMENT

Figure 1:
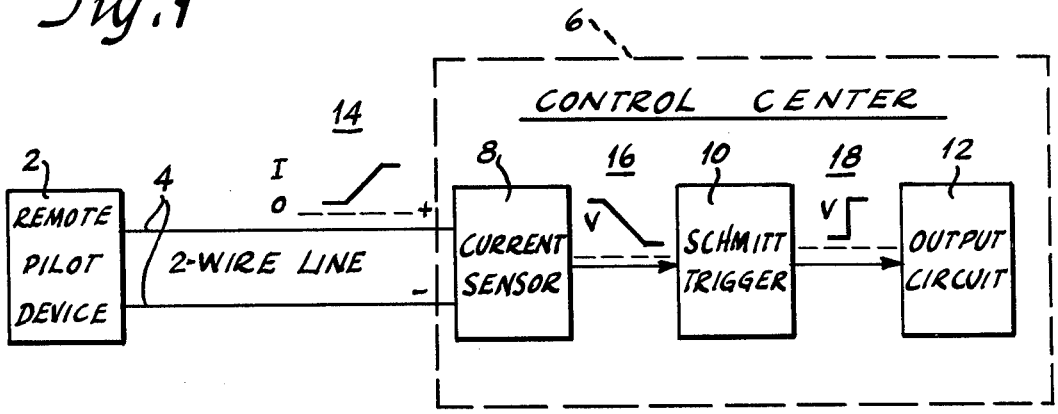
FIG. 1 is a block diagram showing a control system according to the invention including a control center and a long 2-wire line extending therefrom to a remote pilot device.

Referring to FIG. 1, there is shown a 2-wire pilot device system constructed in accordance with the invention. This system is provided with a remote pilot device 2 connected by a long 2-wire line 4 to a control center 6. This control center comprises a current sensor 8 connected to 2-wire line 4, a voltage level sensor such as a Schmitt trigger circuit 10 connected to the current sensor, and an output circuit 12 connected to the Schmitt trigger circuit.

This system functions to activate the output circuit when a control is performed at the remote pilot device. The progressive functions of this system are depicted by graphs between the blocks in the diagram. As shown by graph 14 adjacent the 2-wire line, the remote pilot device provides a variable current signal. Thus, current I in the 2-wire line increases from a low value to a high value in response to operation of the remote pilot device. While an increasing current signal has been shown in FIG. 1 for illustrative purposes, it will become apparent as the description proceeds that either an increasing or decreasing current signal may be used depending upon the type of control to be performed, and the current sensor being suitably adapted to respond to the type of current signal used so as to activate the Schmitt trigger circuit.

This increasing current signal 14 is applied to current sensor 8. As a result, the output of the current sensor switches from high voltage to low voltage as shown by graph 16 adjacent thereto. This low voltage signal is required to operate Schmitt trigger circuit 10. In response thereto, the output of the Schmitt trigger circuit switches from low voltage to high voltage as shown by graph 18 adjacent thereto. This high voltage causes operation of output circuit 12.

Figure 2:
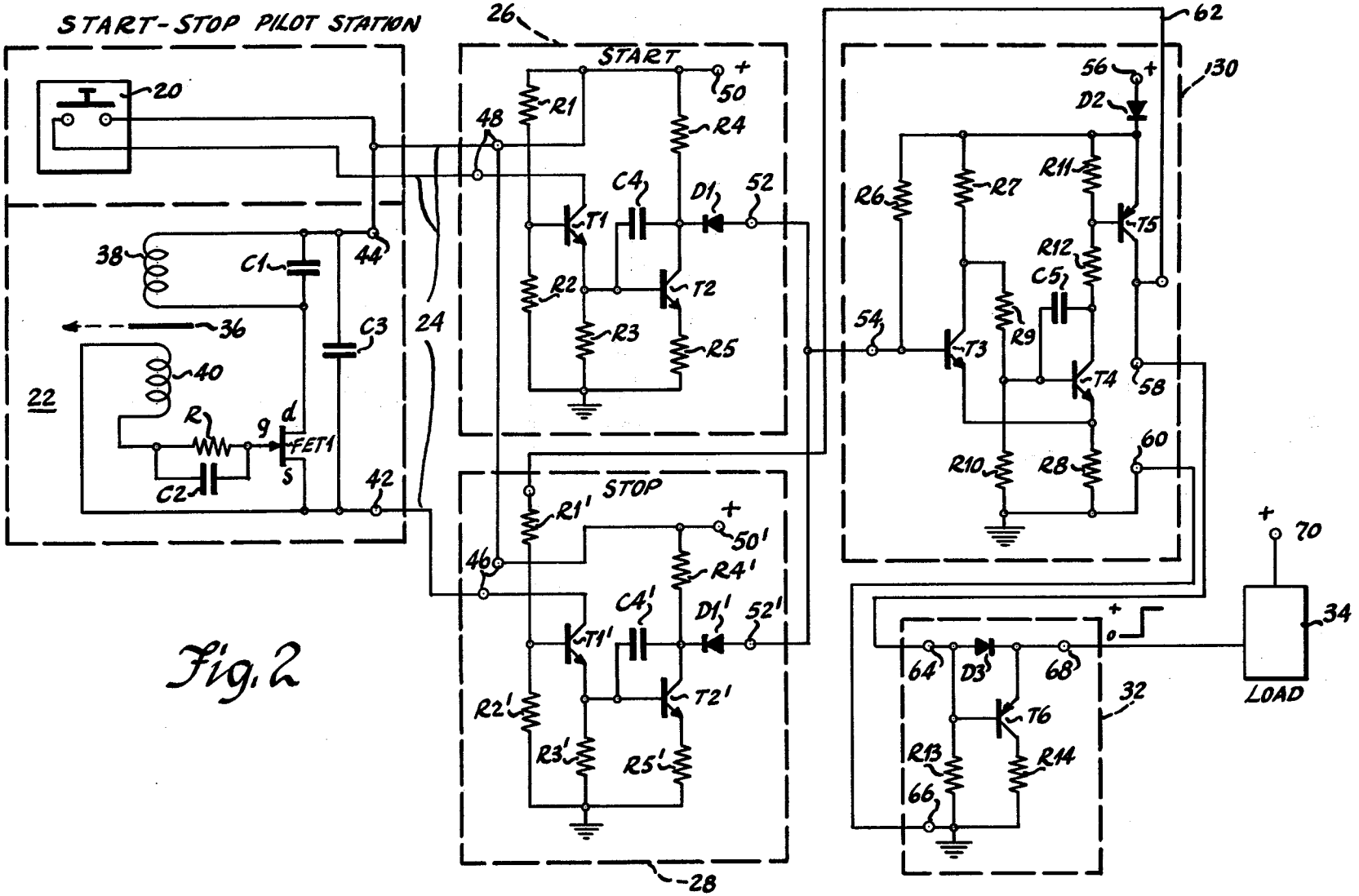
FIG. 2 is a circuit diagram of a control system differing from FIG. 1 in that it includes a start-stop control having two remote pilot devices connected by a 3-wire line to respective start and stop current sensors in the control center, these pilot devices being flag type limit switch and pushbutton versions.

FIG. 2 shows in more detail a start-stop control system, illustrating the use of alternative pilot devices. As shown therein, a start-stop pilot station is located at a remote point and comprises a pair of pilot devices including a "start" pushbutton 20 and a "stop" flag type limit switch 22 connected by a long 3-wire line 24 to a control station. This control station comprises a "start" current sensor 26, a "stop" current sensor 28, a Schmitt trigger circuit 30, and an output circuit or driver 32 for energizing a load 34. While a pair of pilot devices and a pair of current sensors are shown so as to afford start-stop operation, it will be apparent that a single pilot device and the "start" current sensor alone connected by a two-wire line could be used with the Schmitt trigger circuit and the output driver to control the load. In such case, the system would be akin to that shown in block diagram form in FIG. 1. Also, while a normally-open pushbutton has been shown connected to the start current sensor and a flag type limit switch has been shown connected to the stop current sensor, it will be apparent that the flag type limit switch could be used for start purposes and that a pushbutton, normally-closed in this case, could be used for stop purposes, or that pushbuttons could be used for both or flag type limit switches could be used for both.

The start pilot device comprises a normally-open pushbutton switch 20 as shown in FIG. 2 while the stop pilot device comprises a flag type limit switch 22. This flag type limit switch consists of a class C (less than half-cycle conduction) high frequency oscillator that normally oscillates at a frequency of 1 MHz or the like to provide a low level output current and goes into Class A operation (full cycle conduction) or stops oscillating when a metal shield or vane 36 is moved between its coils 38 and 40 which results in an increase in output current. The other elements of this oscillator include a field effect transistor FET1 having its source contact S connected to output terminal 42 and its drain contact d connected through a capacitor C1 to output terminal 44 with coil 38 being connected across capacitor C1 to provide a tank circuit. Its gate electrode g is connected through a resistor R and a capacitor C2 in parallel and then through coil 40 to source contact S. A capacitor C3 is connected across output terminals 42 and 44 which in turn are connected through the upper and lower lines 24 to input terminals 46 of the stop current sensor. Pushbutton switch 20 is connected through the upper and middle lines 24 to input terminals 48 of the start current sensor. Thus, the two pilot devices 20 and 22 are connected by a three-wire line 24 to the control station whereas each pilot device alone would require only a two-wire line for connection as shown schematically in FIG. 1.

"Start" current sensor 26 comprises a first N-P-N transistor T1 having its base connected to the junction between resistors R1 and R2 which are connected in series between positive D.C. source 50 and ground. The collector of transistor T1 is supplied from source 50 through pushbutton switch 20 connected across input terminals 48 while the emitter is connected through resistor R3 to ground. The emitter of transistor T1 is connected to the base of a second N-P-N transistor T2 having its collector supplied from source 50 through resistor R4 while its emitter is connected through resistor R5 to ground. A capacitor C4 is connected between the base and collector of transistor T2 to provide a short delay in turn-on and turn-off of transistor T2 to prevent response to transient voltages. The output is taken from the collector of transistor T2 and is connected through a diode D1 in its high impedance direction to output terminal 52 of the "start" current sensor.

From the foregoing, it will be apparent that transistor T1 is normally biased "on" by current flow from source 50 through voltage divider resistors R1 and R2. However, transistor T1 does not conduct because "start" switch 20 in its collector circuit is open. When this start switch is closed, current flows through transistor T1 and resistor R3 to bias transistor T2 "on". Prior thereto, positive voltage was applied from source 50 through resistor R4 to the cathode of diode D1 so as to block any current flow through output terminal 52 and through this diode. However, when transistor T2 is turned "on" as aforesaid, current may now flow through output terminal 52, diode D1, transistor T2 and resistor R5 to ground for purposes hereinafter described.

To summarize, when the "start" pilot switch is closed, the output of "start" current sensor 26 switches from high voltage to low voltage as shown by curve 16 in FIG. 1 to operate Schmitt trigger circuit 30 as hereinafter described.

"Stop" current sensor 28 is similar to "start" current sensor 26 hereinbefore described and has like components marked with a prime (R1′, R2′, etc.) and differs only in the manner of connecting the base circuit of first transistor T1′ so as to maintain the input signal following momentary operation of "start" pushbutton 20 as hereinafter described.

Schmitt trigger circuit 30 comprises an input terminal 54 to which output terminals 52 and 52′ of the "start" and "stop" current sensors are connected, this input terminal being connected to the base of N-P-N transistor T3. Positive D.C. source 56 is connected through a protective diode D2 in its forward low impedance direction and resistor R6 to the base of transistor T3. Source 56 is also connected through diode D2 and resistor R7 to the collector of transistor T3 while its emitter is connected through resistor R8 to ground. The collector of transistor T3 is connected through voltage divider resistors R9 and R10 to ground while the junction between these resistors is connected to the base of N-P-N transistor T4. Source 56 is connected through diode T2 and resistors R11 and R12 to the collector of transistor T4 while its emitter is connected through resistor R8 to ground. A capacitor C5 is connected between the collector and base of transistor T4 to provide a short delay in turn-on and turn-off of transistor T4 to prevent response to transient voltages. The junction between resistors R11 and R12 is connected to the base of P-N-P transistor T5. Source 56 is connected through diode D2 to the emitter of transistor T5 while its collector is connected to upper output terminal 58, lower output terminal 60 being connected to ground.

A maintaining circuit is also connected from the collector of transistor T5 through conductor 62 and resistors R1′ and R2′ to ground, while the junction between these resistors is connected to the base of transistor T1′ in the "stop" current sensor circuit. From this it will be seen that whenever transistor T5 is off, transistor T1′ will be biased off. But whenever transistor T5 is turned on, transistor T1′ will be biased on to maintain the load energization as hereinafter described.

Driver circuit 32 comprises a pair of input terminals 64 and 66 connected to output terminals 58 and 60, respectively, of the Schmitt trigger circuit. Terminal 64 is connected to the base of P-N-P transistor T6 and also through resistor R13 to input terminal 66 which is grounded. Input terminal 64 is also connected through a diode D3 in its forward low impedance direction to the emitter of transistor T6 while its collector is connected through resistor R14 to ground. The output is taken from the junction between the cathode of diode D3 and the emitter of transistor T6 and applied through output terminal 68 and load 34 to positive D.C. source 70.

The operation of the system of FIG. 2 will now be described. Initially, the transistors in the start and stop current sensors, the Schmitt trigger circuit and the output driver circuit are in the following conditions.

T1 — biased on but non-conducting
T2 — off
T1′ —biased off

T2 — off
T3 — on
T4 — off
T5 — off
T6 — on

These conditions come about in the following manner.

It will be recalled from the foregoing that when vane 36 is between the coils of flag-type limit switch 22 as shown in FIG. 2, this limit switch provides a high current output and when this vane is subsequently removed therefrom as indicated by the broken line arrow, the output current drops to a low value. Thus, a high current source is applied to the collector of transistor T1′ to enable it to conduct when it becomes biased on by the Schmitt trigger circuit as hereinafter described. In the meantime it is biased off.

In the start current sensor, transistor T1, although biased on, does not conduct because start pilot switch 20 in its collector circuit is open. Therefore, transistor T2 also does not conduct so that positive D.C. voltage is applied to block gating diode D1.

In the stop current sensor, since transistor T1′ is biased off as aforesaid because conductor 62 is connected through resistor R13 to ground, transistor T2′ is also off so that positive D.C. voltage from source 50′ blocks gating diode D1′.

Thus, the "sink" outputs of the start and stop current sensors at output terminals 52 and 52′ are off or "high". Due. to this, current from source 56 flows through the base-emitter junction of transistor T3 to bias it on. The resultant low voltage at the collector of transistor T3 biases transistor T4 off which in turn biases transistor T5 off. As a result, the output of driver 32 at its output terminal 68 is "low". This comes about by current flow from source 70 through load 34, the emitter-base junction of transistor T6 and resistor R13 to ground. This biases transistor T6 on so that current flows through its emitter-collector junction and resistor R14 to ground. Resistor R14 has a low resistance value so that a logic "low" appears at output terminal 68 of this driver circuit.

When pushbutton switch 20 is momentarily closed, transistor T1 conducts and biases transistor T2 on. This drops the voltage at the collector of transistor T2 enough so that current is diverted from the base-emitter junction of transistor T3 into the "sink" output of the start current sensor. This current flows through terminals 54 and 52, diode D1, transistor T2 and resistor R5 to ground. As a result, transistor T3 turns off, allowing transistor T4 to turn on. The resultant current flow through and voltage drop on resistor R11 turns transistor T5 on, applying positive D.C. voltage from source 56 through diode D2 and transistor T5 to output terminal 58. Diode D2 prevents damage to the transistors if connected to the wrong polarity.

This output voltage of the Schmitt trigger circuit is fed back through conductor 62 to bias transistor T1′ on whereupon it conducts since high current is supplied from "stop" pilot device 22. Transistor T1′ biases transistor T2′ on to provide a maintaining "sink" output to input terminal 52 of the Schmitt trigger circuit. Thus, the input signal to the Schmitt trigger circuit is maintained so that pushbutton switch 20 may be released to allow it to reopen.

Transistor T5 being turned on as aforesaid, current flows from source 56 through diode D2, transistor T5, output terminal 58, driver input terminal 64 and resistor R13 to ground. The voltage drop on resistor R13 due to this current flow raises the voltage at the base of driver transistor T6 to reverse bias its emitter-base junction and turn it off. As a result, the logic output at driver output terminal 68 changes from "low" to "high". This high may be used as a logic turn-on signal for load 34.

The system can be turned off by moving vane 36 out from between coils 38 and 40. As a result, the stop pilot device oscillator goes back into class C oscillation to reduce its current output from about 40 ma (on) to about 10 ma (off). This reduction in current in transistor T1′ biases transistor T2′ off. This interrupts the maintaining circuit at the input of the Schmitt trigger circuit whereby transistor T3 turns on again, shunts the base-emitter of transistor T4 to turn it off. This interrupts the emitter-base current in transistor T5 to turn it off. As a result, output terminal 68 of driver 32 switches from logic "high" to "low" thereby restoring the initial condition of the system.

Figure 9:
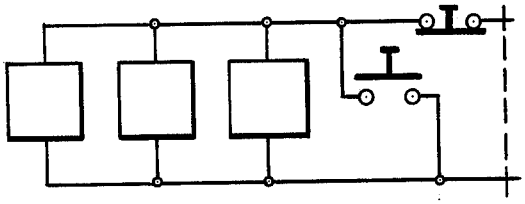
FIG. 9 is a schematic diagram showing parallel connection of pilot devices for an OR logic input to a control system such as shown in FIG. 1.
Figure 10:
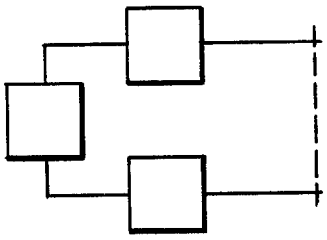
FIG. 10 is a schematic diagram showing series connection of pilot devices for an AND logic input to a control system such as shown in FIG. 1.

Pilot devices such as flag type limit switch 22 in FIG. 2 may be connected in parallel or series as shown in FIGS. 9 and 10 to provide either logic OR or AND inputs as desired.

Figure 3:
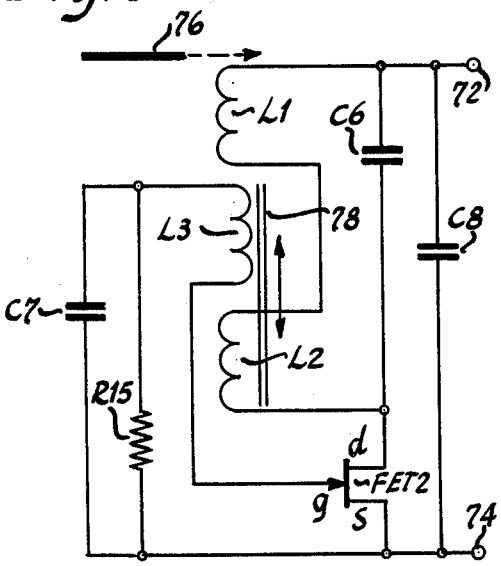
FIG. 3 is a circuit diagram showing a magnetic type proximity switch version of pilot device that is usable as an alternative to either pilot device in FIG. 2 or as the pilot device in FIG. 1.

FIG. 3 shows a magnetic type proximity switch circuit that may be used in the systems of FIGS. 1 or 2. This circuit comprises a two-wire pilot device having a 500 KHz oscillator operating in Class C which limits the average current in the output line to a relatively low value such as 10 ma. When a conductor is in proximity to the magnetic field of the coils, the oscillator goes into Clas A operation or stops oscillating which results in an increase in current to about 40 ma.

The amplifying device of this proximity switch circuit is a field effect transistor FET2 having its drain contact *d* connected through the oscillator tank circuit to output terminal 72, this tank circuit including a capacitor C6 connected in parallel with series-connected coils L1 and L2. Source contact S is connected to output terminal 74. Gate electrode g of the field effect transistor is connected through pickup coil L3 and then in parallel through a capacitor C7 and a resistor R15 to source contact S. A smoothing capacitor C8 is connected across output terminals 72 and 74. An electrical conductor 76 is adapted to be moved into proximity with the magnetic field of the coils as indicated by the broken line arrow adjacent thereto. The coils have an adjustable ferrous core 78 or slug for adjusting the coil coupling as hereinafter described.

In this proximity switch in FIG. 3, coils L1 and L2 are parts of a two-section coil wound in opposition and coil L3 is the pickup coil connected in the gate circuit which when this circuit is oscillating, develops a negative gate bias voltage in the C7, R15 circuit. Capacitor C8 smooths the current and reduces RFI (radio frequency interference) radiation. To initiate and sustain oscillation for low current Class C operation, the coupling between coils L1 and L3 is adjusted to be greater than the coils L2 to L3 coupling which results in a voltage induced in coil L3 of the proper phase. This adjustment is made by moving ferrite slug 78 mounted in a nylon screw inside the coil mounting member. When conductor 76 is moved into the magnetic field, the coupling between coils L1 and L2 causes their opposing voltages to become nearly equal and the oscillation stops. This develops a high current output.

Proximity switch circuits as shown in FIG. 3 may be connected in parallel or series as shown in FIGS. 9 and 10 for logic OR or AND inputs to the system hereinbefore described.

Figure 4:
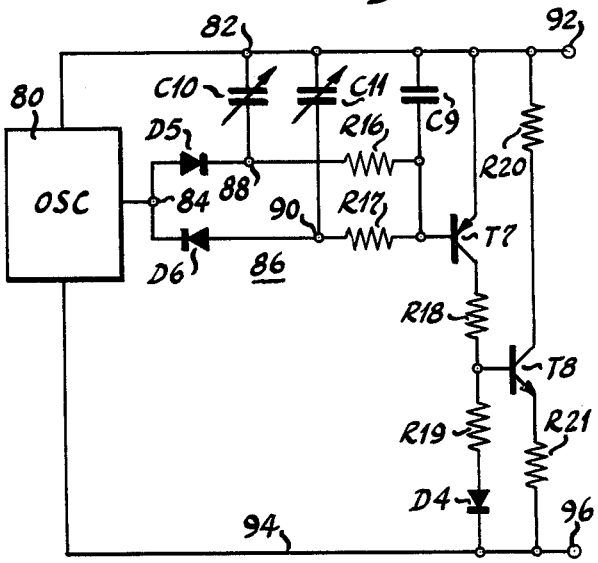
FIG. 4 is a circuit diagram showing a capacitance type proximity switch version of pilot device that is usable as an alternative to the pilot devices of FIGS. 2 and 3 or as the pilot device of FIG. 1.

FIG. 4 shows a capacitance type proximity switch circuit that may be used in the systems of FIGS. 1 and 2 or connected in parallel as shown in FIG. 9 for logic OR inputs. This circuit comprises a two-wire pilot device having a one MHz oscillator 80 of the AMELCO type or the like connected across input terminals 82 and 84 of an impedance bridge circuit 86 whose output terminals 88 and 90 are connected through respective resistors R16 and R17 to the base of a P-N-P transistor T7. The emitter of transistor T7 is connected to bridge input terminal 82 as well as output terminal 92 of the proximity switch circuit while its collector is connected through resistors R18 and R19 and a unidirectional diode D4 in series to common conductor 94, this common conductor being also connected to oscillator 80 and to output terminal 96. A smoothing capacitor C9 is connected between the emitter and base of transistor T7. The junction of resistors R18 and R19 is connected to the base of N-P-N transistor T8 while its collector is connected through resistor R20 to output terminal 92 and its emitter is connected through resistor R21 to common conductor 94 as well as to the other output terminal 96 of the proximity switch.

The aforementioned bridge circuit 86 comprises a pair of oppositely poled unidirectional diodes D5 and D6 connected between its input terminal 84 and its respective output terminals 88 and 90, and a pair of capacitors C10 and C11 connected between its input terminal 82 and respective output terminals 88 and 90. Either capacitor C10 or C11 is variable or they may be variable in opposite directions by a condition to be sensed so that the capacitance of one increases and the capacitance of the other decreases simultaneously to unbalance the bridge. The oscillator supplies 1 MHz alternating current to this bridge. When the bridge is unbalanced in one direction, there is no output current to the base of transistor T7. When a metallic or non-metallic member comes into proximity of the bridge capacitor or capacitors or the capacitance is varied by plate movement or dielectric change or the like, the bridge unbalances in the other direction and supplies an output current to the base of transistor T7 to turn it on. This transistor T7 and its circuit constitutes an amplifier that amplifies the output signal from the unbalanced bridge and applies it to transistor T8 to bias it on and close a circuit between output terminals 92 and 96.

Figure 5:
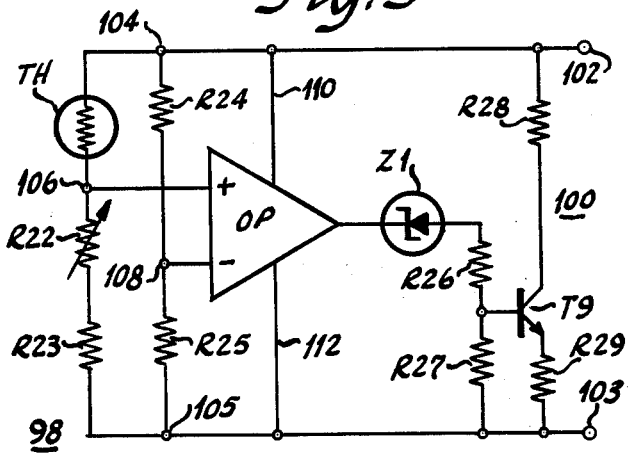
FIG. 5 is a circuit diagram showing a temperature responsive switch version of pilot device that is usable as an alternative to the pilot devices of FIGS. 2–4 or as the pilot device of FIG. 1.

The temperature responsive switch circuit shown in FIG. 5 may be used in the circuits of FIGS. 1 and 2 or a plurality thereof may be connected in parallel as shown in FIG. 9 for OR logic inputs. This circuit comprises a resistance bridge 98, an operational amplifier comparator OP and an output transistor circuit 100 for closing a circuit between output terminals 102 and 103 which would serve as an input signal to either the start or stop current sensor in FIG. 2.

The aforementioned resistance bridge 98 in FIG. 5 comprises a pair of input terminals 104 and 105 and a pair of output terminals 106 and 108. This bridge includes two branches between input terminals 104 and 105. The first branch includes a temperature responsive device such as a thermistor TH, output terminal 106 and resistors R22 and R23 in series, resistor R22 being adjustable. The second branch includes resistor R24, output terminal 108 and resistor R25 in series.

This thermistor TH is a semi-conductor device that exhibits a high negative temperature coefficient (NTC) of resistivity, that is, as its temperature goes up, its resistance goes down and vice versa. Thus, this thermistor will function to sense a change in ambient temperature and unbalance the bridge to provide an electrical signal indicative thereof. Alternatively, a positive temperature coefficient (PTC) thermistor or other equivalent material, appropriately placed in the bridge, could be used.

Variable resistor R22 is used to balance the bridge at ambient temperature so that no current flows in the output terminals. These bridge output terminals 106 and 108 are connected to the non-inverting (+) and inverting (−) input terminals, respectively, of operational amplifier OP which is supplied with positive voltage from output terminal 102 through conductor 110 with its other supply conductor 112 being connected to output terminal 103 of the temperature responsive switch circuit.

The output terminal of the comparator is connected through a zener diode Z1 and resistors R26 and R27 in series to output terminal 103, the junction between these resistors being connected to the base of output N-P-N transistor T9. The collector of this transistor is connected through resistor R28 to supply voltage at output terminal 102 while its emitter is connected through resistor R29 to output terminal 103. It will be apparent that when this temperature responsive switch circuit is connected to input terminals 48 or 46 of the start or stop current sensors in FIG. 2, supply voltage will be supplied from source 50 or 50′ to its output terminal 102.

When the temperature increases as aforesaid to unbalance the bridge, the voltage at the non-inverting input of the amplifier goes more positive than the voltage at the inverting input and the amplifier output switches almost to the supply voltage value due to its high gain. This voltage is then fed to the base of power transistor T9 through zener diode ZD and resistor R26. This zener diode provides an offset voltage between the amplifier output and the base of the transistor for reliable turn-off. This amplifier output turns transistor T9 on, closing the circuit between output terminals 102 and 104.

Figure 6:
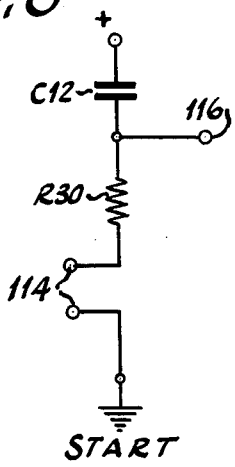
FIG. 6 is a circuit diagram showing a simplified and more economical current sensor suitable for use in place of the "start" current sensor of FIG. 2 when a pushbutton type pilot device is used therewith.

FIG. 6 shows a simplified start current sensor circuit usable with a pushbutton switch or contact type pilot device. For example, this economical current sensor could be connected between pushbutton switch 20 and Schmitt trigger circuit 30 in place of start current sensor 26 in FIG. 2. This circuit comprises a pair of input terminals 114 across which a pushbutton switch is adapted to be connected and an output terminal 116 adapted to be connected to input terminal 54 of the Schmitt trigger circuit in FIG. 2. A D.C. source is connected through a capacitor C12, a resistor R30 and input terminals 114 to ground. The junction between capacitor C12 and resistor R30 is connected to output terminal 116.

Normally, capacitor C12 is partially charged through output terminal 116, the base-emitter junction of transistor T3 and resistor R8 in the Schmitt trigger circuit. When the pilot switch is closed, the voltage on output terminal 116 is dropped lower to operate the Schmitt trigger circuit. This capacitor C12 then charges further through resistor R30 to delay operation of the Schmitt trigger circuit until any pilot switch contact bounce has ended.

Figure 7:
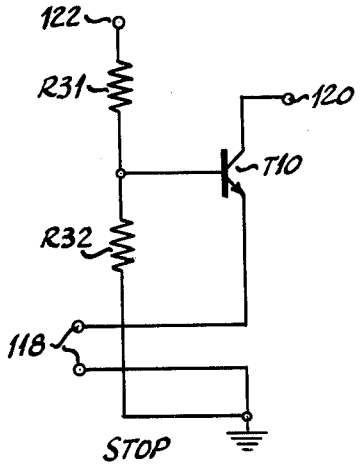
FIG. 7 is a circuit diagram showing a simplified and more economical current sensor suitable for use in place of the "stop" current sensor of FIG. 2 when a pushbutton type pilot device is used therewith.

FIG. 7 shows a simplified stop current sensor circuit usable with a pushbutton switch or contact type pilot device. For example, this current sensor circuit could be connected between a normally-closed pushbutton stop switch and Schmitt trigger circuit 30 in FIG. 2. This circuit comprises a pair of input terminals 118 across which the pilot switch is adapted to be connected and an output terminal 120 adapted to be connected to input terminal 54 of Schmitt trigger circuit 30 in FIG. 2. A maintaining terminal 122 which is adapted to be connected to conductor 62 in FIG. 2 is connected through resistors R31 and R32 to ground with the junction between these resistors being connected to the base of N-P-N transistor T10. The collector of this transistor is connected to output terminal 120 and its emitter is connected through input terminals 118 to ground.

Normally, transistor T10 is non-conducting because ground from conductor 62 is connected to its base. However, when the Schmitt trigger circuit is operated to apply positive voltage to conductor 62, this voltage goes through resistor R31 to the base of transistor T10 to bias it on. As a result, transistor T10 connects ground potential to the Schmitt trigger circuit input to maintain the latter on until the stop pilot switch is opened.

Figure 8:
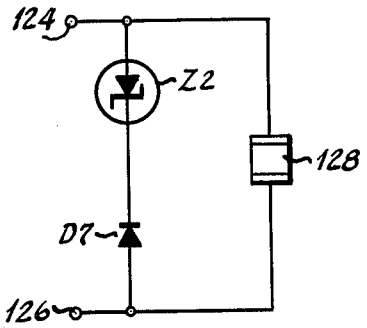
FIG. 8 is a circuit diagram showing a relay version of output that is usable as an alternative to the logic output circuit of FIG. 2 or as the output circuit in FIG. 1.

FIG. 8 shows a relay version of output device that may be used in FIG. 2 in place of logic output circuit 32. This relay circuit comprises input terminals 124 and 126 and a relay coil 128 connected thereacross, this relay coil having suitable contacts, not shown. A unidirectional diode D7 and a zener diode Z2 are connected in series across the relay coil, diode D7 being poled to conduct current in response to the induced voltage of the coil. Zener diode Z2 makes the relay restore on turn-off faster. This relay circuit is adapted to be connected across output terminals 58 and 60 of the Schmitt trigger circuit in FIG. 2.

FIGS. 9 and 10 show possible parallel and series connections of pilot devices as hereinbefore mentioned.

Figure 11:
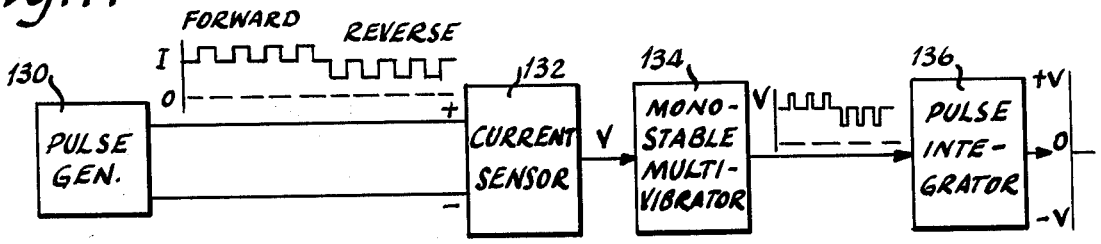
FIG. 11 is a block diagram of a control system constituting a tachometer device having a pulse input and an analog voltage output proportional to the pulse frequency.
Figure 12:
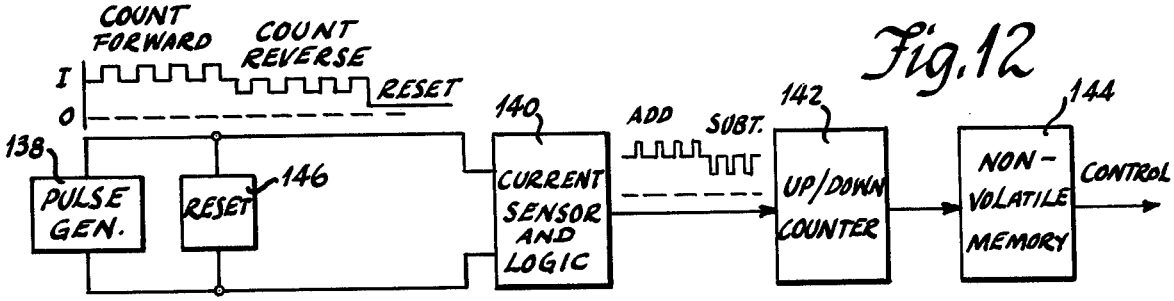
FIG. 12 is a block diagram of a control system constituting a motion transducer device having a bidirectional pulse input and a non-volatile memory output proportional to the algebraic sum of the input pulses.

FIGS. 11 and 12 show additional systems that can be built by using some of the component circuits hereinbefore described.

In FIG. 11, a tachometer system is shown wherein a pulse generator 130 is connected by a 2-wire line to a current sensor 132. As depicted thereat, this pulse generator may send either positive pulses indicative of forward movement or negative pulses indicative of reverse movement. The current sensor applies a positive or negative voltage V to a monostable multivibrator 134 which develops uniform-width square-wave pulses of positive or negative polarity. These pulses are integrated in a pulse integrator 136 to provide an analog voltage indicative of the speed and direction of rotation of whatever drives pulse generator 130.

In FIG. 12, a motion transducer system is shown wherein a pulse generator 138 is connected by a 2-wire line to a current sensor and logic 140. This pulse generator sends count forward and count reverse pulses of opposite polarity to the current sensor and logic as depicted thereat. This current sensor and logic then sends add-subtract pulses of opposite polarity to up-down counter 142. This up-down counter then sends a signal proportional to the algebraic sum of the add-subtract pulses to a non-volatile memory 144. Such non-volatile memory retains its information in the absence of power, and indicates the resultant motion of the device that drives pulse generator 138. A reset device 146 is connected across the input pulse generator for sending a signal as depicted thereat for resetting the up-down counter to zero.

Figure 13:
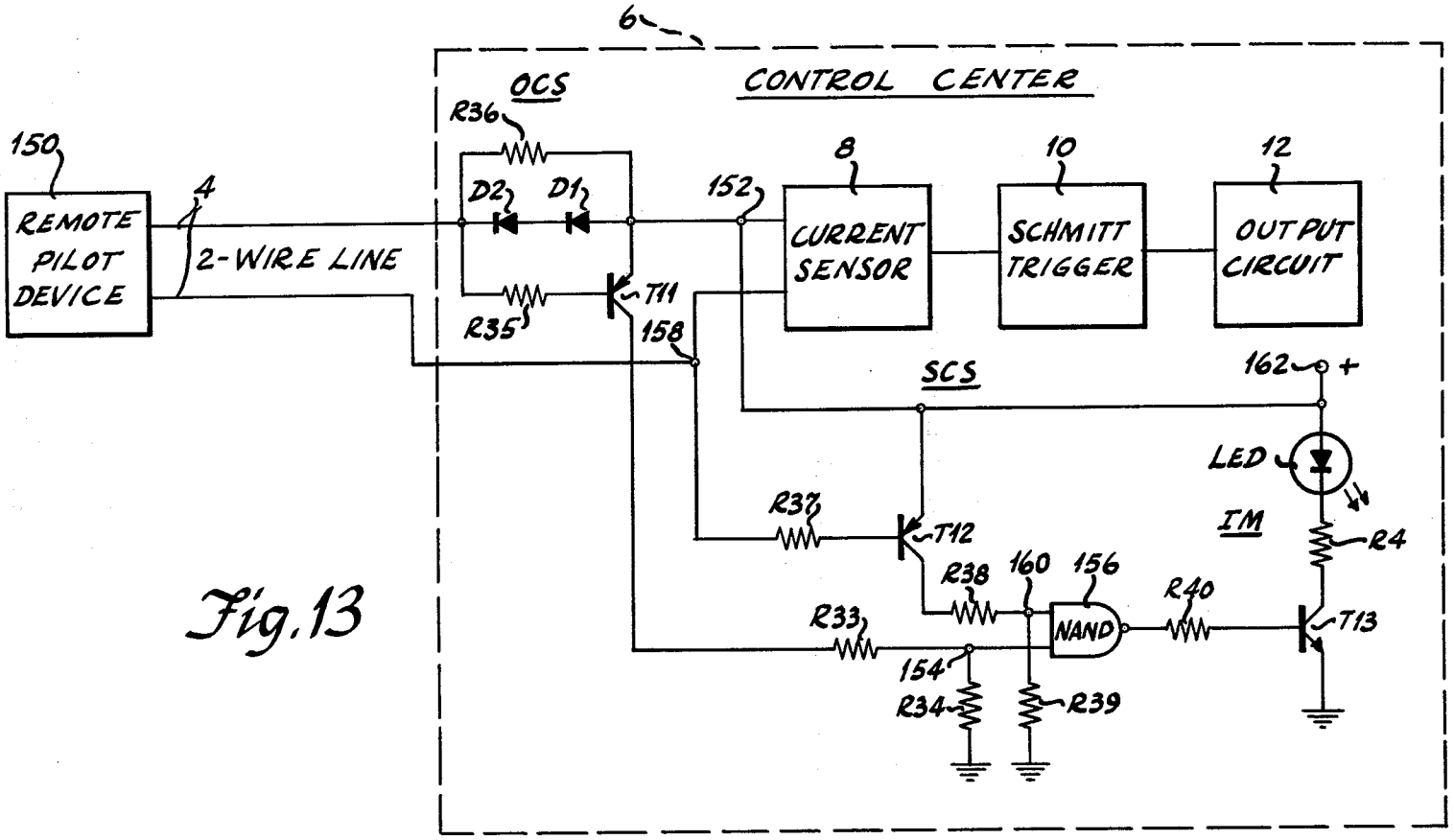
FIG. 13 is a block diagram like that shown in FIG. 1 but additionally showing schematically open and shorted line detector and indicator means.

FIG. 13 shows fault detector means comprising open and shorted line sensor and indicator means applied to the system of FIG. 1, with the exception that the remote pilot device may not be a switch like switch 20 in FIG. 2 but must be an impedance device such as flag type limit switch 22 in FIG. 2, magnetic type proximity switch shown in FIG. 3, capacitance type proximity switch shown in FIG. 4, temperature responsive switch shown in FIG. 5 or the like. This is for the reason that a pushbutton switch such as 20 in FIG. 20 would cause a shorted line indication when closed and an open line indication when open. Reference characters like those in FIG. 1 have been used in FIG. 13 for like parts.

As shown in FIG. 13, a remote pilot device 150 of the aforementioned type is connected by two-wire line 4 to current sensor 8 in control center 6, there being an open circuit sensor OCS interposed in the upper conductor of line 4 at the input to current sensor 8 in control center 6. Current sensor 8 is connected to Schmitt trigger circuit 10 and the latter is connected to output circuit 12 as in the system of FIG. 1.

Open circuit sensor OCS comprises means for providing a high logic signal when there is no open circuit fault and for providing a low logic signal when there is an open circuit fault. This means comprises a P-N-P conductivity type transistor T11 having its emitter connected to upper input terminal 152 of current sensor 8 and its collector connected through resistors R33 and R34 in series to ground, with the junction 154 between these resistors, which is the output terminal of the open circuit sensor, being connected to one input of a NAND gate 156. The base of transistor T11 is connected through a resistor R35 to the upper conductor of line 4. A pair of diodes D1 and D2 are connected in their forward, low impedance direction in series across the emitter-base junction of transistor T11 and resistor R35. A resistor R36 is connected across diodes D1 and D2.

A shorted circuit sensor SCS is connected across input terminals 152 and 158 of current sensor 8.

This shorted circuit sensor SCS comprises a P-N-P conductivity type transistor T12 having its emitter connected to terminal 152 and its base connected through a resistor R37 to terminal 158. Its collector is connected through resistors R38 and R39 to ground, with the junction 160 between these resistors, which is the output terminal of the shorted circuit sensor, being connected to the other input of NAND gate 156.

A positive voltage source 162 is connected to the emitter of transistor T12 and also through terminal 152 to the emitter of transistor T11.

Indicator means IM for the open and shorted line detectors or sensors comprises NAND gate 156 having its output connected through a resistor R40 to the base of an N-P-N conductivity type transistor T13. D.C. source 162 is connected through a visual indicator such as light emitting diode LED and a resistor R41 to the collector of transistor T13 while its emitter is connected to ground.

In operation, indicator LED normally is not lit. This is for the reason that when the line is neither open nor shorted, both transistors T11 and T12 conduct, applying high logic signals from source 162 to both inputs of NAND gate 156, causing its output to remain low. Thus, transistor T13 is turned off and diode LED is not lit.

NAND gate 156 may be a COS/MOS integrated circuit such that its output goes low only if both inputs are high and if either input goes low, its output goes high to turn transistor T13 on.

Normally, when there is no open fault on the line, current flows in the emitter base circuit of transistor T11 to keep this transistor turned on. As a result, a high is applied from the D.C. source through its emitter-collector circuit to one input of NAND gate 156.

Also, when there is no short on the line, a voltage appears across the emitter-base circuit of transistor T12 causing current to flow therein to keep this transistor turned on. As a result, a high is applied from the D.C. source through its emitter-collector circuit to the other input of NAND gate 156.

With highs on both inputs, NAND gate 156 output remains low to keep the indicator off.

If an open occurs on the line, the base-emitter current of transistor T11 goes to zero causing this transistor to turn off. As a result, ground, which is a low, is applied through resistor R34 to one input of NAND gate 156 causing its output to go high. This causes base-emitter current to flow to turn transistor T13 on and light the indicator thereby to show that an open circuit exists on the line.

On the other hand, if a short occurs on the line, the base-emitter circuit of transistor T12 becomes shunted causing the voltage thereacross to go to zero to turn the transistor off. As a result, ground, which is a low, is applied through resistor R39 to the other input of NAND gate 156 causing its output to go high. This causes transistor T13 to turn on to light the indicator thereby to show that a short exists on the line.

While the indicator illustrated does not distinguish between open and short faults on the line, this can be done by using separate indicator circuits connected to output terminals 154 and 160 of the open circuit and short circuit sensors.

While the systems hereinbefore described are adapted to fulfill the objects stated, it is to be understood that the invention is not intended to be confined to the particular preferred embodiments of 2-wire pilot device solid state control systems disclosed, inasmuch as they are susceptible of various modifications without departing from the scope of the appended claims.

I claim:

1. A solid state pilot system comprising:

a remote station comprising pilot means operable to provide a change in current level from a first level to a second level in response to operation thereof;

a control center comprising current sensor means;

a two-wire line connecting said pilot means to said current sensor means;

solid state means in said current sensor means for providing a change in control voltage value in response to said change in current level;

a solid state voltage level sensor responsive to said change in control voltage value for providing a switched output signal;

and means responsive to said switched output signal for operating a load device;

said solid state means in said current sensor means comprising a transistor and means biasing said transistor for conduction;

and said two-wire line being connected in the collector circuit of said transistor thereby to cause a change in conduction in response to said change in current level.

2. A solid state pilot system defined in claim 1, wherein:

said pilot means comprises a flag type proximity limit switch circuit having an oscillator normally operating in Class C whereby the current in said two-wire line is limited to a relatively low value and a condition responsive conductor movable in proximity thereto for causing said oscillator to go into Class A operation or to stop oscillating which results in an increase in current in said two-wire line.

3. The solid state pilot system defined in claim 1, wherein:

said solid state voltage level sensor comprises a Schmitt trigger circuit having an input transistor and means normally biasing said input transistor to conduction;

and said solid state means in said current sensor means for providing a change in control voltage value comprises means for shunting said biasing means to render said input transistor non-conducting.

4. The solid state pilot system defined in claim 1, wherein:

said means responsive to said switched output signal for operating a load device comprises a logic circuit for providing a "low" or "high" signal in selective response to said switched output signal of said solid state voltage level sensor.

5. The solid state pilot system defined in claim 1, wherein:

said pilot means comprises a magnetic type proximity switch circuit having an oscillator including magnetic coils balanced whereby the current in said two-wire line is limited to a relatively low value and a condition responsive magnetic member movable in proximity to said coils to unbalance the magnetic field thereof thereby to cause an increase in current in said two-wire line.

6. The solid state pilot system defined in claim 1, wherein said pilot means comprises a temperature responsive circuit having:

an impedance bridge including a temperature responsive device in one branch thereof;

a high gain comparator responsive to unbalance of said bridge in response to temperature change for providing an output signal;

and switching means responsive to said output signal for changing the current level in said two-wire line.

7. The solid state pilot system defined in claim 1, wherein said pilot means comprises a capacitance type proximity switch having:

an oscillator providing an alternating current;

a bridge circuit including capacitance and rectifier elements normally in balanced condition;

at least one of said capacitance elements being variable in response to a proximity condition to unbalance said bridge and provide a control signal;

and means responsive to said control signal for changing the current level in said two-wire line.

8. The solid state pilot system defined in claim 1, wherein said control center also comprises:

fault detector and indicator means comprising:

an open circuit sensor interposed between said two-wire line and said current sensor means and comprising means responsive to either said first or said second current level for providing a first logic signal and being responsive to said current level falling to zero in open circuit for providing a second logic signal;

and indicator means responsive to said second logic signal for providing a visual indication.

9. The solid state pilot system defined in claim 8, wherein:

said open circuit sensor comprises a detector transistor and control means connected to one wire of said two-wire line for rendering said transistor conductive at either said first or second current level and non-conductive at said zero current level, and means responsive to conduction of said transistor for providing said first logic signal and responsive to non-conduction of said transistor for providing said second logic signal;

and said indicator means comprises a solid state indicator and an operating transistor and means responsive to said second logic signal for rendering said operating transistor conducting to energize said solid state indicator.

10. The solid state pilot system defined in claim 1, wherein said control center also comprises:

fault detector and indicator means comprising:

a short circuit sensor connected across said two-wire line at its point of connection to said current sensor and comprising means responsive to the voltage across said two-wire line produced by either said first or said second current level for providing a first logic signal and being responsive to the voltage across said two-wire line falling to zero on short circuit for providing a second logic signal;

and indicator means responsive to said second logic signal for providing a visual indication.

11. The solid state pilot system defined in claim 10, wherein:

said short circuit sensor comprises a detector transistor and control means connected across said two-wire line for rendering said detector transistor conductive by the voltage thereacross at either said first or second current level and non-conductive at said zero-voltage, and means responsive to conduction of said transistor for providing said first logic signal and responsive to non-conduction of said transistor for providing said second logic signal;

and said indicator means comprises a solid state indicator and an operating transistor and means responsive to said second logic signal for rendering said operating transistor conducting to energize said solid state indicator.

12. A solid state pilot system comprising:

a remote station having a start pilot device operable to provide a change in current level in one direction in response to operation thereof and a stop pilot device operable to provide a change in current level in the other direction in response to operation thereof;

a control center comprising current sensor means;

a three-wire line connecting said start and stop pilot devices to said current sensor means;

said current sensor means comprising a start current sensor having solid state means for providing a first directional change in control voltage value in response to said one directional change in current level in said start pilot device and a stop current sensor having solid state means for providing a change in control voltage value in response to said other directional change in current level in said stop pilot device;

a solid state voltage level sensor responsive to said change in control voltage from said start pilot device for providing a switched output signal;

means in said stop current sensor responsive to said switched output signal for maintaining said first directional change in control voltage value on said solid state voltage level sensor;

and means responsive to said switched output signal for operating a load device.

* * * * *